US006877835B2

(12) United States Patent
Kato et al.

(10) Patent No.: US 6,877,835 B2
(45) Date of Patent: Apr. 12, 2005

(54) METHOD OF FILLING BUFFER CHAMBER IN PRINT HEAD WITH BUBBLE AND PRINTING APPARATUS

(75) Inventors: Masao Kato, Tochigi (JP); Fumihiro Gotoh, Kanagawa (JP); Akitoshi Yamada, Kanagawa (JP); Daisaku Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 09/995,719

(22) Filed: Nov. 29, 2001

(65) Prior Publication Data

US 2002/0085061 A1 Jul. 4, 2002

(30) Foreign Application Priority Data

Nov. 30, 2000 (JP) ..... 2000-366296

(51) Int. Cl.[7] ..... B41J 2/165
(52) U.S. Cl. ..... 347/30; 347/92; 347/94
(58) Field of Search ..... 347/92, 94, 30

(56) References Cited

U.S. PATENT DOCUMENTS 6,109,734 A * 8/2000 Kashino et al. ..... 347/65
6,260,962 B1 7/2001 Yano et al.

FOREIGN PATENT DOCUMENTS

| | | | |
|---|---|---|---|
| EP | 496533 | * | 7/1992 |
| JP | 5-31904 | | 2/1993 |
| JP | 6-270413 | | 9/1994 |
| JP | 8-39800 | | 2/1996 |

* cited by examiner

*Primary Examiner*—Stephen Meier
*Assistant Examiner*—Ly T Tran
(74) *Attorney, Agent, or Firm*—Fitzpatrick, Cella, Harper & Scinto

(57) ABSTRACT

The present invention allows a buffer portion to sufficiently restrain the vibration of ink in a print head. To achieve this, the buffer portion is disposed close to a channel between a common chamber and an ejection opening and is filled with at least one bubble, and then excess of the at least one bubble is removed through the ejection opening.

14 Claims, 6 Drawing Sheets

METHOD OF FILLING BUFFER CHAMBER IN PRINT HEAD WITH BUBBLE AND PRINTING APPARATUS

This application is based on Patent Application No. 2000-366296 filed Nov. 30, 2000 in Japan, the content of which is incorporated hereinto by reference.

BACKGROUND OF THE INVENTION

1. Field of the Invention

The present invention relates to a method of filling a buffer chamber in a print head with bubbles and a corresponding printing apparatus.

2. Description of the Related Art

Known print heads are constructed so as to allow a plurality of ejection openings to be in communication, through a plurality of channels, with a common liquid chamber to which ink is supplied so that the ink in the common liquid chamber is selectively ejected through the plurality of ejection openings. With such a print head, a variation in pressure occurring when the ink is ejected is transmitted to the common liquid chamber, where the ink is then vibrated, causing the ink to be ejected unstably. A method of solving this problem is to fill a buffer chamber that is in communication with the common liquid chamber, with bubbles so that the buffer chamber serves to restrain the ink in the common liquid chamber from vibrating. When there are no bubbles in the buffer chamber, the heater provided correspondingly to the buffer chamber is driven to generate the bubbles in the ink in order to fill the buffer chamber therewith.

When the buffer chamber is to be filled with bubbles, control is provided so that the bubbles will not overflow the buffer chamber. If the bubbles overflow the buffer chamber, some of the bubbles become unstable and move along with the flow of the ink. These unstable bubbles must be sufficiently removed. If these bubbles invade any channel, the ink is ejected unstably. However, it is difficult to control the size of bubbles to be provided so as to prevent them from overflowing the buffer chamber. Thus, the danger of leakage is avoided by filling the buffer chamber with bubbles, the amount of which is substantially smaller than the capacity of the buffer chamber.

Further, the conventional buffer configuration does not allow bubbles to be sufficiently removed easily.

SUMMARY OF THE INVENTION

It is an object of the present invention to provide a method of filling a buffer chamber in a print head with bubbles and a printing apparatus wherein the buffer chamber, which can restrain ink from vibrating, is reliably filled with an appropriate amount of bubbles to enable functions of the buffer chamber to be sufficiently effected.

In a first aspect of the present invention, there is provided a method of filling a buffer chamber in a print head with bubbles, using a print head comprising a plurality of ejection openings through which ink is ejected, a plurality of channels that are each in communication with a corresponding one of the plurality of channels, a common liquid chamber for supplying ink to the plurality of channels, a buffer chamber located at end of an arrangement direction of the channels to restrain vibration of ink in the common liquid chamber which occurs as a result of ejection of the ink, and bubble generating means for filling the buffer chamber with bubbles, comprising the steps of:

filling the buffer chamber with bubbles by driving the bubble generating means; and executing a recovery process of discharging the ink through the ejection opening after the bubble filling process.

In a second aspect of the present invention, there is provided a printing apparatus able to print an image on a printing medium, using a print head comprising a plurality of ejection openings through which ink is ejected, a plurality of channels that are each in communication with a corresponding one of the plurality of channels, a common liquid chamber for supplying ink to the plurality of channels, a buffer chamber located at end of an arrangement direction of the channels to restrain vibration of ink in the common liquid chamber which occurs as a result of ejection of the ink, and bubble generating means for filling the buffer chamber with bubbles, comprising:

recovery process means for causing the ink to be discharged through the ejection openings, wherein the recovery process means causes the ink to be discharged through the ejection openings after the bubble generating means has filled the buffer chamber with bubbles.

According to the present invention, the buffer portion, which efficiently restrains the vibration of ink at the location close to the channel between the common liquid chamber and the ejection openings, is filled with bubbles, and then excess bubbles are removed through the ejection opening. Thus, the buffer chamber is reliably filled with bubbles to enable the functions of the buffer portion to be sufficiently exhibited, thereby allowing the ink to be ejected stably and achieving high-grade image printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

[Embodiment 1]

Figure 1:
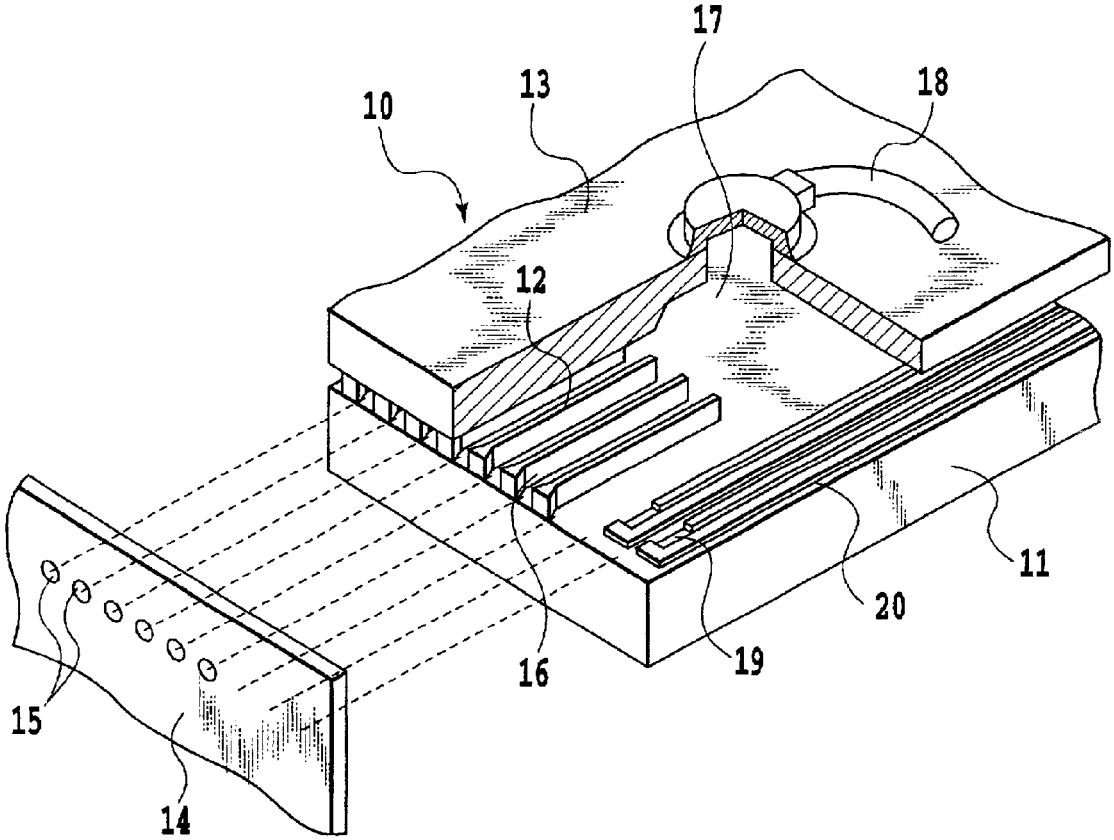
FIG. 1 is an exploded perspective view of an essential part of a print head to which the present invention is applicable.

FIG. 1 is an exploded perspective view of an essential part of a print head to which the present invention is applicable. In the print head 10 in this example, reference numeral 11 denotes a substrate having a plurality of liquid chamber walls formed therein, 13 denotes a top plate, and 14 denotes an orifice plate having a plurality of ejection openings 15 formed therein. The substrate 11, top plate 13, and orifice plate 14 are coupled together to form a plurality of channels 16 that are in communication with the respective ejection openings 15 and a common liquid chamber 17 that is in communication with all of the plurality of channels 16. Ink for image printing is supplied from an ink supplying section (not shown) to the common liquid chamber 17 through a supply tube 18. The ink in the common liquid chamber 18 is supplied to the channels 16 owing to a capillary phenomenon and is then stably held therein by forming meniscus at the ejection openings 15, located at the tips of the channels 16. Each of the channels 16 has a heating element (electrothermal converter) 19 disposed therein. Electricity is provided to the heating element 19 through a wire 20 to cause the element 19 to generate thermal energy to heat the ink in the channels 16. Then, a bubble is generated because of film boiling, and the resulting bubbling energy causes an ink droplet to be ejected through the ejection opening 15. By densely arranging the ejection openings 15, for example, at 400 dpi, a multi-ejection opening print head 10 based on the ink-jet printing method is constructed. Further, a predetermined number of (in this case, four) channels 16 located at opposite ends of the print head 10 in a nozzle arrangement direction have no corresponding ejection openings 15 formed therewith and are thus blocked. These predetermined number of channels 16 have an inner wall structure similar to that of channels constituting the nozzles, through which ink is ejected, except that they have no ejection openings. These predetermined number of channels 16 constitute buffer chambers that do not contribute to ejecting ink. These buffer chambers form a buffer portion, described later, and the heating elements 19 in the buffer chambers are used to fill the chambers with bubbles.

Figure 2:
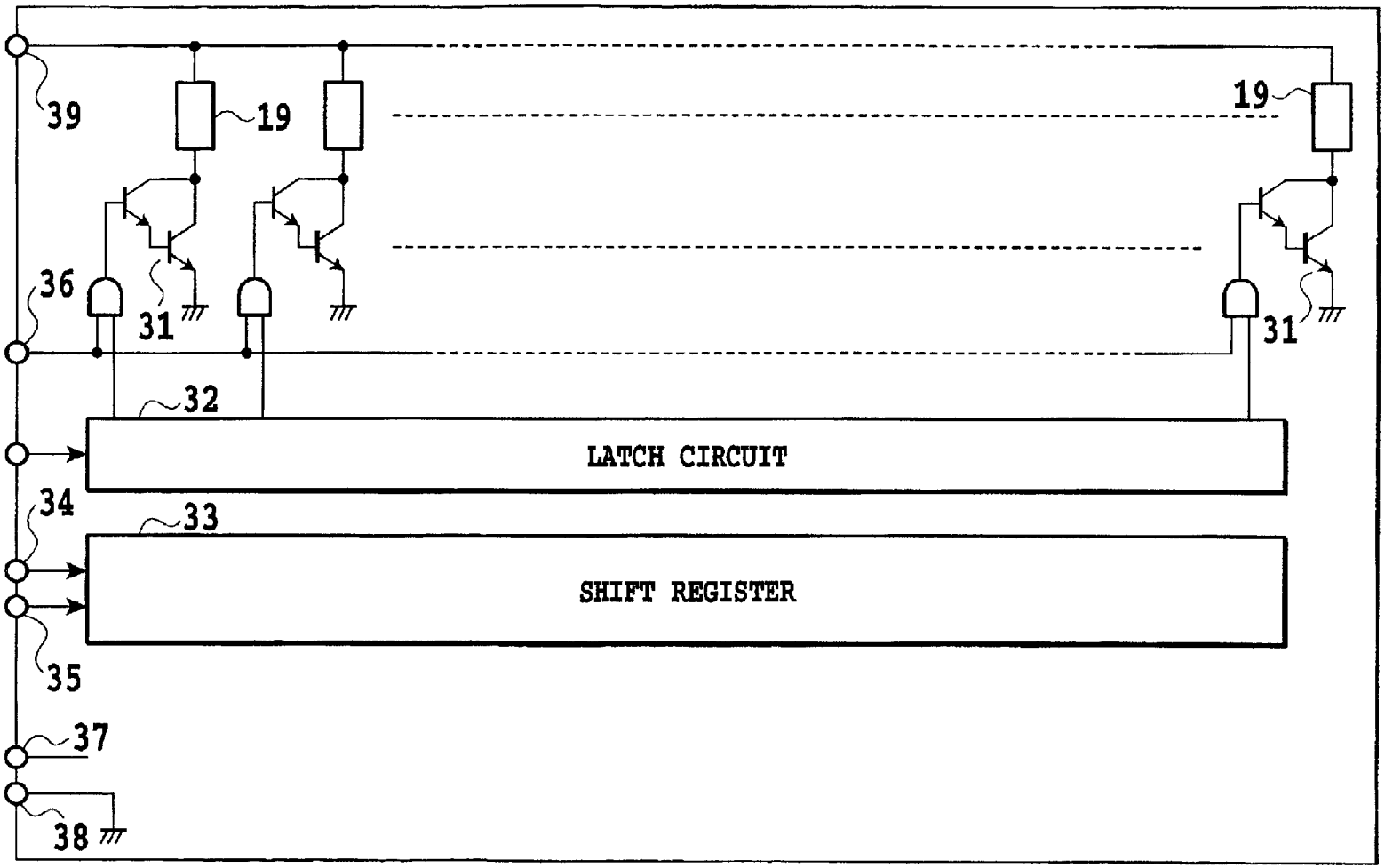
FIG. 2 is a diagram of a circuit on the substrate of the print head in FIG. 1.

FIG. 2 is a diagram of a circuit on a substrate for a print head constituting the substrate 11. The heating elements 19 are arranged in a line. Reference numeral 31 denotes a power transistor, 32 denotes a latch circuit, and 33 denotes a shift register. Reference numeral 34 denotes a terminal that receives a clock signal for shifting data in the shift register 33, and 35 denotes a terminal that receives serial image data. Reference numeral 36 denotes a heat pulse input terminal that externally controls the on time of the power transistor 31. Reference numeral 37 denotes a logic power supply terminal, 38 denotes a ground terminal, and 39 denotes an input terminal for a power supply (VH) for driving the heating elements 19.

In a printing apparatus comprising such a print head 10, serial image data is serially input to the shift register 33 through the input terminal 35. The image data, set in the shift register 33, is latched in the latch circuit 32. Then, when a pulse is input to the circuit through the heat pulse input terminal 36, the power transistors 31 with the image data are turned on to conduct electricity through the corresponding heating elements 19 in order to drive them. The driven heating element 19 heat the ink in the channels 16 in which they are located, thereby causing film boiling. Thus, a bubble is generated in the ink, and the resulting bubbling energy causes an ink droplet to be ejected through the ejection opening 15. The ink droplet impacts on a printing medium to form an image thereon. Further, the heating elements 19 in the buffer chambers, in which the channel 16 is blocked, are driven by data set in the shift register 33, as in the case with the heating elements 19 in the other nozzles. The heating elements 19 in the buffer chambers are driven in order to fill the chambers with bubbles as described later.

During a printing operation, data is transferred, which dries the heating elements 19 in the ejection openings that do not constitute the buffer chambers. Further, to fill the buffer chambers with bubbles, data is input which drives only the heating elements 19 in the buffer chambers. The heating elements 19 in the buffer chambers, when driven, heat the ink while preventing film boiling from occurring therein, but causing bubbles to be generated in the ink. Further, the heating elements 19 in the buffer chambers preferably heat the ink to the degree that only the precipitation of the gas dissolved in the ink is effected, or heat the ink to the degree that nucleate boiling occurs in the ink. Further, to fill the buffer chambers with bubbles, data may be input which drives the heating elements 19 in the buffer chambers and input to the other ejection openings, so as to drive all these heating elements 19. In this case, the entire print head 10 is heated to allow bubbles to be generated easily. Further, in this case, simultaneously with the driving of the heating elements 19 in the buffer chambers or slightly before or after the driving, the heating elements in all the nozzles that do not constitute the buffer chambers, or in particular ejection nozzles (for example, a predetermined number of nozzles in the vicinity of the buffer chambers), may be driven. These heating elements 19 may be driven while preventing the ink from being ejected through the ejection openings 15 or similarly to the heating elements 19 in the buffer chambers.

Figure 3:
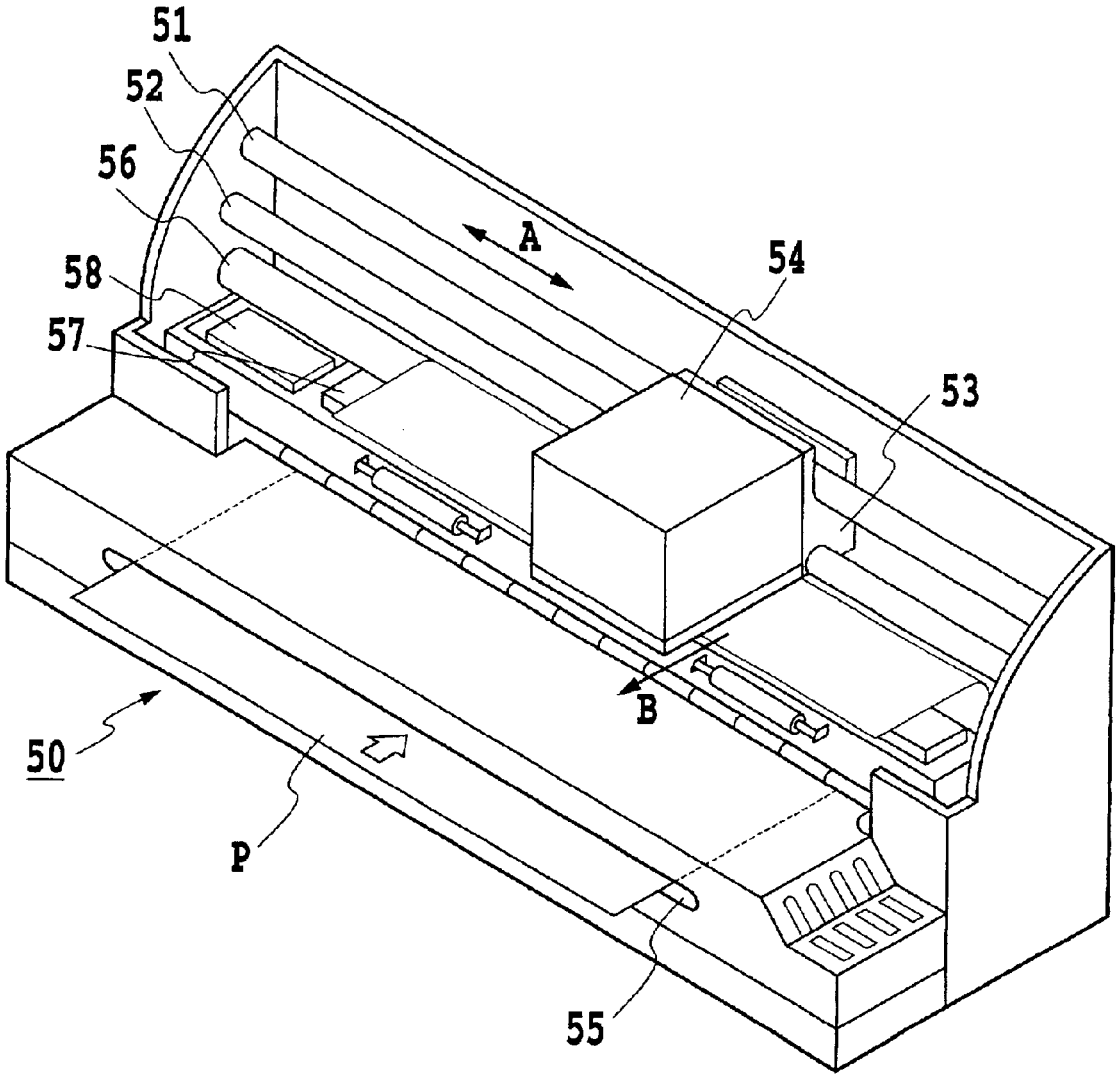
FIG. 3 is a perspective view of an essential part of a printing apparatus to which the present invention is applicable.

FIG. 3 is a perspective view schematically illustrating a configuration of an essential part of a printing apparatus to which the present invention is applicable. The printing apparatus 50 in this example is based on the serial scan method. A carriage 53 is guided by guide shafts 51 and 52 so as to be movable in a main-scanning direction, shown by an arrow A. The carriage 53 is reciprocated in the main-scanning direction by a carriage motor and a driving force transmitting mechanism such as a belt which transmits a driving force from the motor. The carriage 53 has the print head 10 (not shown in FIG. 3) and an ink tank 54 mounted therein, the ink tank 54 supplying ink to the print head 10. The print head 10 and the ink tank 54 may constitute an ink jet cartridge. A sheet P as a printing medium is inserted through an insertion port 55 formed in the front end of the apparatus, subsequently has its transportation direction reversed, and is then transported in a sub-scanning direction, shown by an arrow B, by a feed roller 56. The printing apparatus 50 sequentially prints by repeating a printing operation and a transporting operation. In the printing operation, the print head 10 moves in the main-scanning direction while ejecting the ink to a print area in the sheet P on a platen 57. In the transporting operation, the sheet P is transported in the sub-scanning direction by a distance corresponding to a printing width.

At the left end of the movement area of the carriage 53 is provided a recovery system unit (recovery processing means) 58. The recovery system unit 58 faces a surface, in which the ejection openings 15 are formed, of the print head 10 mounted in the carriage 53. The recovery system unit 58 comprises a cap that can cap the ejection openings 15 in the print head 10, a suction pump that can introduce negative pressure into the cap, and other elements. The recovery system unit 58 executes a recovery process (also referred to as a "suction recovery process" by introducing negative pressure into the cap, covering the ejection openings 15, to suction and discharge the ink through the ejection openings 15, thereby maintaining a good ink ejection state of the print head 10. A recovery process (also referred to as an "ejection recovery process" can also be executed by causing ink not contributing to the image printing to be ejected through the ejection openings 15, thereby maintaining a good ink ejection state of the print head 10.

Figure 4:
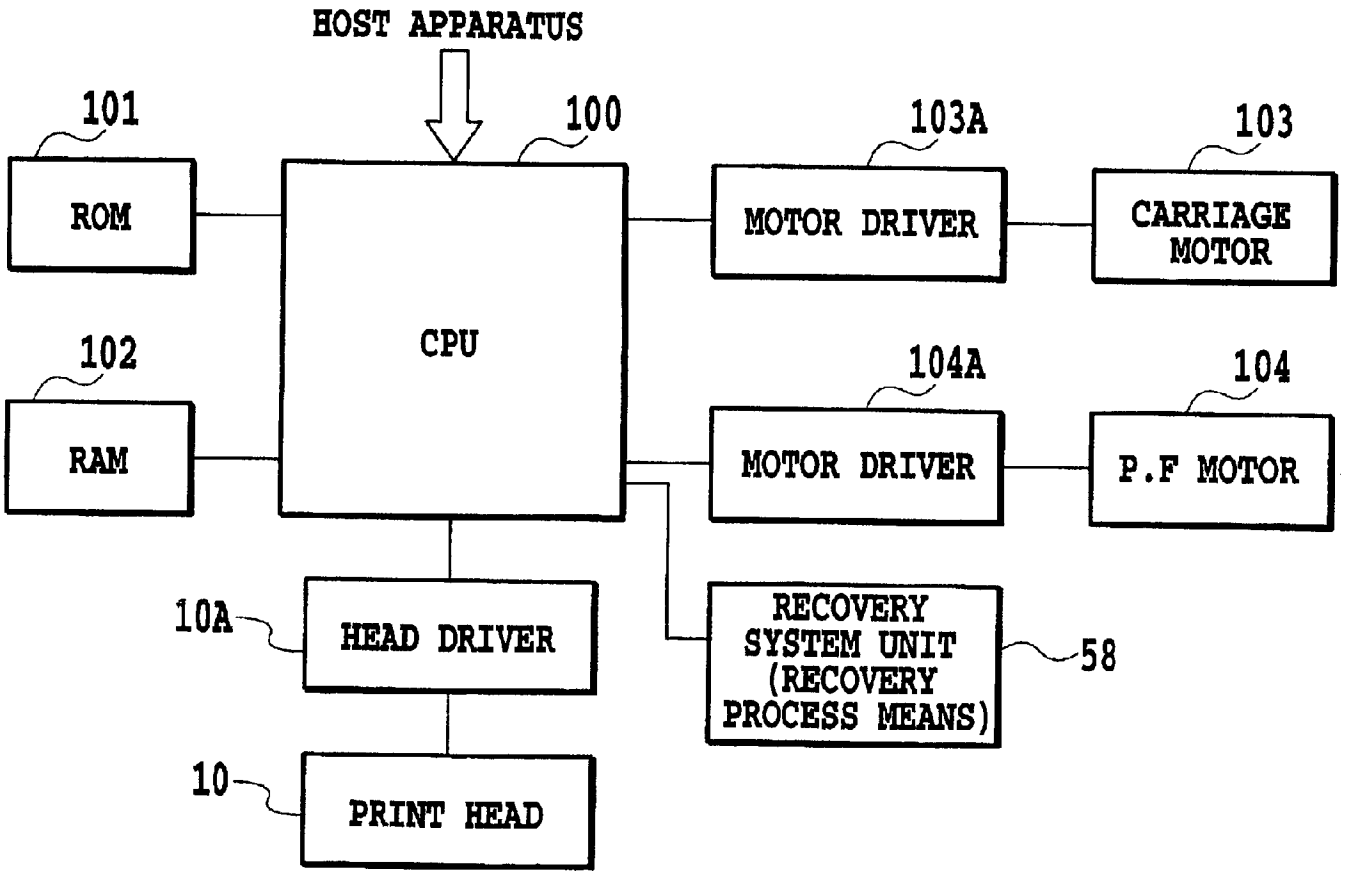
FIG. 4 is a schematic block diagram of a configuration of a control system in the printing apparatus in FIG. 3.

FIG. 4 is a schematic block diagram of a configuration of a control system for a printing apparatus to which the present invention is applicable. In this figure, a CPU 100 executes processes of controlling the operation of this printing apparatus, data processing, and other processes. A ROM 101 stores programs for the procedures of these processes and the like, and a RAM 102 is used as a work area in which these processes are executed.

The ink is ejected from the print head 10 by the CPU 100 by providing a head driver 10A with driving data (image data) and a driving control signal (heat pulse signal) for the heating elements 19. The head driver 10A may also be constructed on the print head substrate as shown in FIG. 2. Further, to fill the buffer chambers with bubbles, the driving data and driving control signal for the heating elements 19 in the buffer chambers are provided to the head driver 10A. The CPU 100 controls, via a motor driver 103A, a carriage motor 103 for driving the carriage 53 in the main-scanning direction. Further, the CPU 100 controls, via a motor driver 104A, a P.F motor 104 for transporting the sheet P in the sub-scanning direction. Furthermore, the CPU 100 executes the suction recovery process or the ejection recovery process by controlling the recovery system unit 58.

Figure 5:
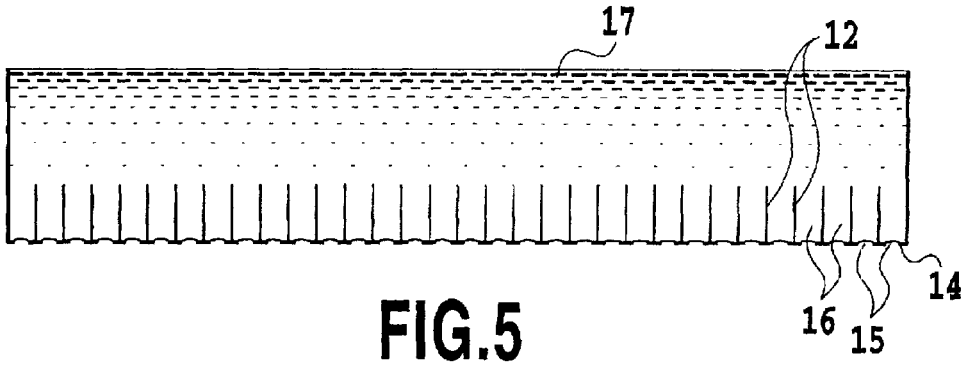
FIG. 5 is a schematic plan view illustrating a conventional example of a print head.

FIG. 5 is a schematic diagram illustrating a configuration of a conventional example of a print head with no buffer portion formed therein. This print head has no buffer chamber, which can absorb the vibration of the ink, formed therein. Thus, ink supplied to the respective channels 16 is ejected downward in FIG. 5 through the ejection openings 15 when the heating elements 19 (not shown in FIG. 5) in these channels 16 are driven.

Figure 6:
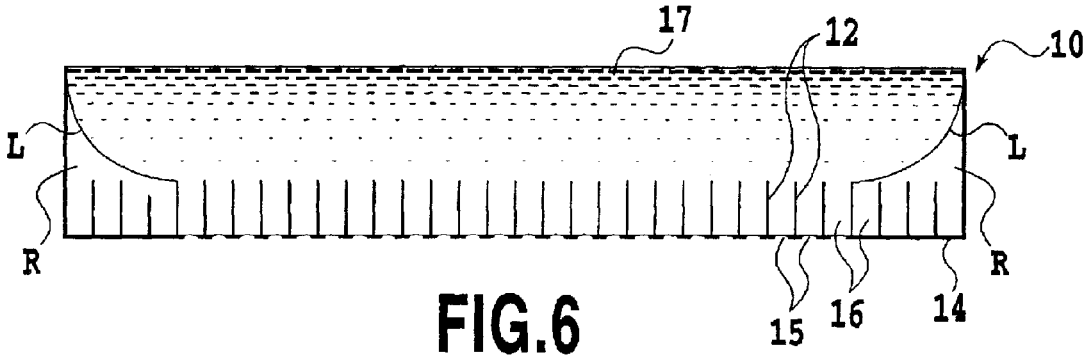
FIG. 6 is a schematic plan view of a print head to which the present invention is applicable.

FIG. 6 is a schematic diagram of the print head 10 to which the present invention is applicable. In this example, eight nozzles, that is, four nozzles at each of the opposite ends of the print head in the nozzle arrangement direction constitute buffer chambers because the ejection openings 15 thereof are blocked. A buffer portion R, which is filled with bubbles from the buffer chambers, is formed at each of the opposite ends of the common liquid chamber 17. Reference character L in FIG. 6 denotes the interface between the ink and bubble. The heating elements 19 in the buffer chambers are driven to precipitate the gas dissolved in the ink in the buffer chambers so that the buffer portions R are filled with the precipitated bubbles as shown in FIG. 6. Accordingly, the heating elements 19 in the buffer chambers function as bubble generating means for filling the buffer portions R with bubbles. In the other nozzles that do not constitute the buffer chambers, the heating elements 19 are driven to induce film boiling in the ink in the nozzles to cause the ink to generate bubbles. Then, the resulting bubbling energy causes ink droplets to be ejected through the, ejection openings 15. At this time, the vibration of the ink transmitted to the common liquid chamber 17 through the channels 16 is efficiently restrained by the bubbles in the buffer portions R, located in the vicinity of the channels 16, thereby allowing the ink to be ejected stably. The heating elements 19 in the other nozzles that do not constitute the buffer chambers function as means for generating ejection energy that causes the ink to be ejected.

If the bubbles in the buffer portions R decrease owing to the printing operation, secular change, or environmental change of the temperature and the like, the heating elements 19 in the buffer chambers are driven to precipitate the gas dissolved in the ink in the buffer chambers in order to fill the buffer portions R with the precipitated bubbles.

Figure 7:
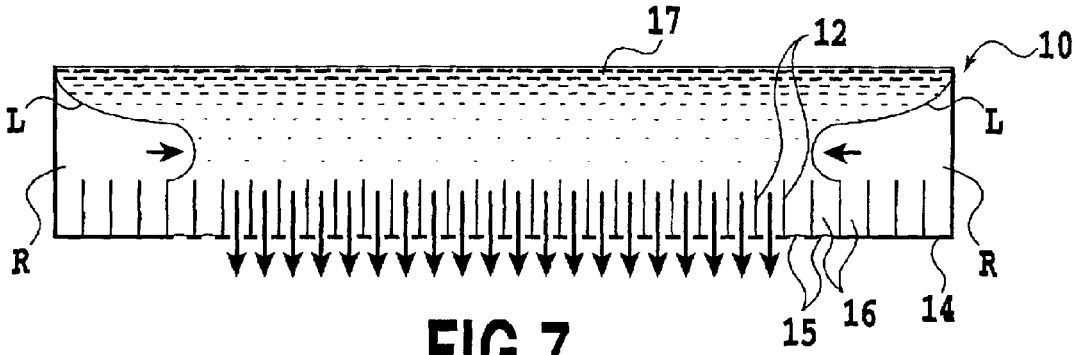
FIG. 7 is a diagram illustrating that the print head in FIG. 6 is excessively filled with bubbles.
Figure 8:
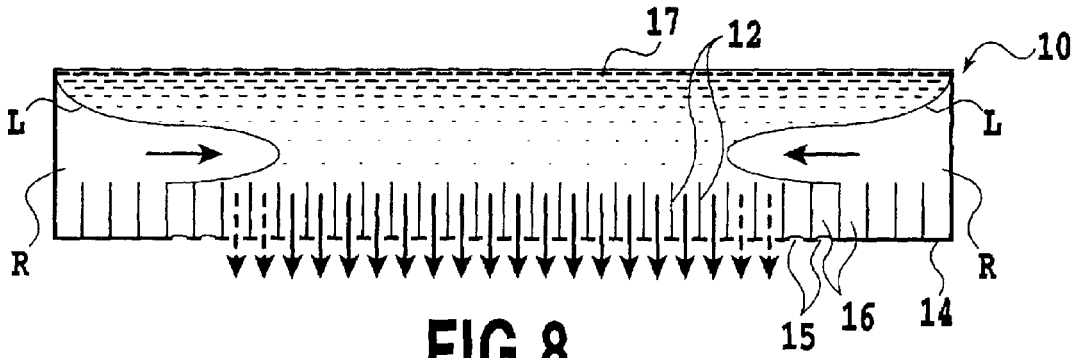
FIG. 8 is a diagram illustrating that the print head in FIG. 6 is excessively filled with bubbles.

If the bubbles grow so significantly that the buffer portion R is filled with an excess bubble volume, and a printing operation is performed with the buffer portion filled with excess bubble volume, then the ink may be ejected inappropriately. That is, bubbles overflowing the buffer portion R may block the channels 16 with the nozzles through which the ink is to be ejected, causing the ink to be ejected inappropriately. FIG. 7 is a diagram illustrating that an amount of bubbles are overflowing the buffer portions R If bubbles leaking from the buffer portions R block the two channels 16 of the nozzles located adjacent to the buffer chambers as shown in this figure, then the ink may be improperly ejected through these nozzles. FIG. 8 is a diagram illustrating that a larger amount of bubbles is overflowing the buffer portions R. If bubbles leaking from each of the buffer portions R block the four channels 16 of the nozzles located adjacent to the buffer chambers as shown in this figure, then the ink may be improperly ejected through these nozzles.

Figure 9A:
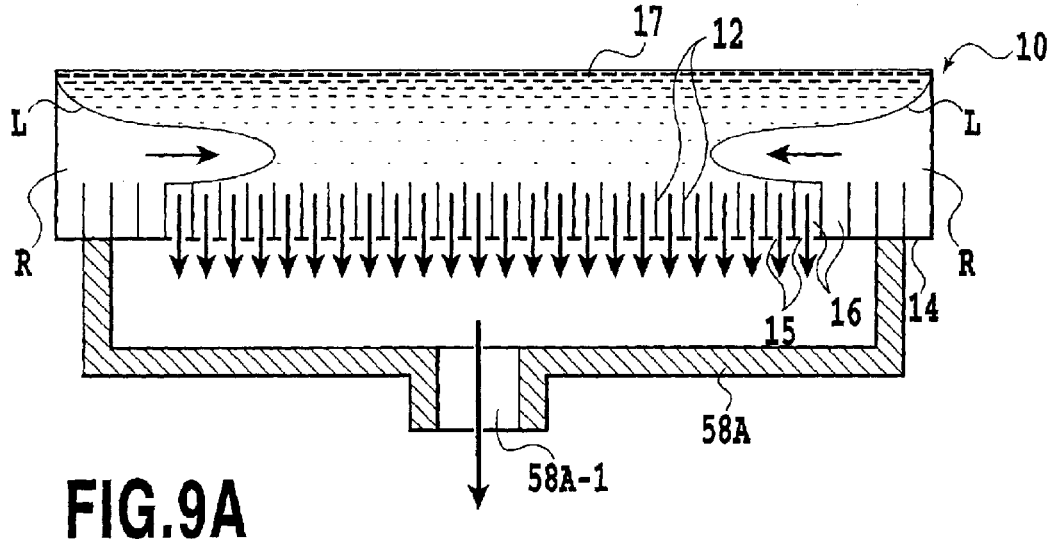
FIGS. 9A, 9B, and 9C are diagrams showing an operation of filling the print head in FIG. 6 with bubbles.
Figure 9B:
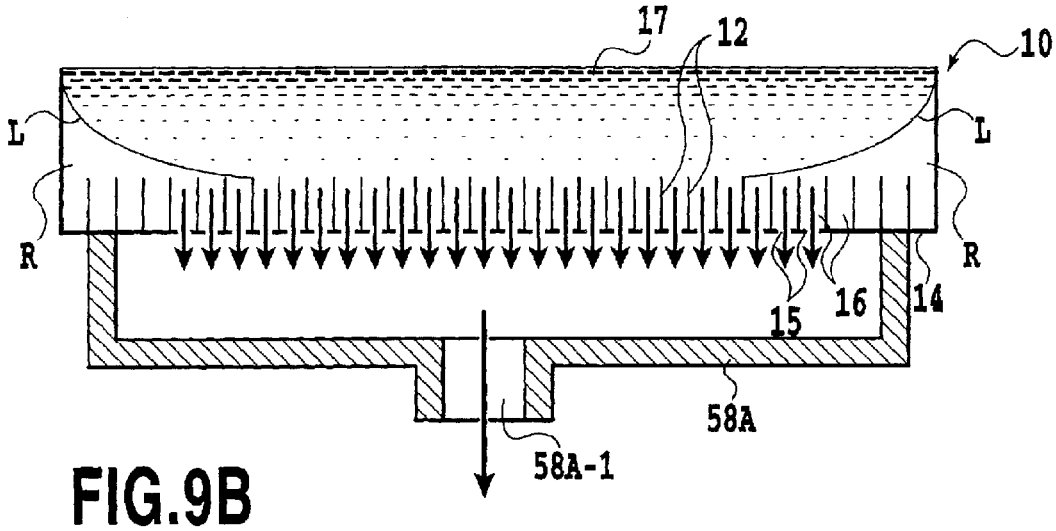
Figure 9C:
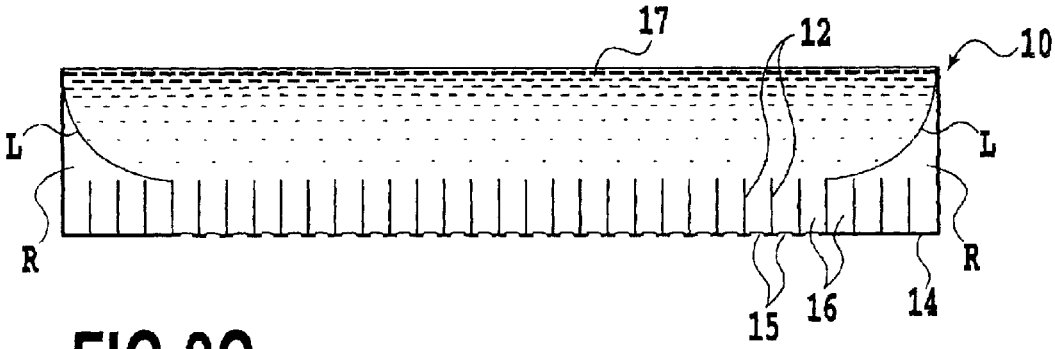

In view of these circumstances, the present invention ensures that the buffer portions R are filled with an appropriate amount of bubbles. FIGS. 9A, 9B, and 9C are diagrams illustrating this filling method. In these figures, reference numeral 58A denotes a cap provided in the recovery system unit 58. A suction port 58A-1 in the cap 58A is connected to a suction pump (not shown). As described previously, the suction recovery process can be executed by placing the cap 58A over the print head 10 so as to cover the ejection openings 15, and then introducing negative pressure into the cap 58A to suction and discharge the ink through the ejection openings 15.

To fill the buffer portions R with bubbles, the heating elements 19 in the buffer chambers are first driven. Subsequently, as shown in FIG. 9A, the cap 58A is installed, and negative pressure is then introduced into the cap 58A. Then, as shown by the arrows in the figure, the suction recovery process is executed by suctioning and discharging the ink through the ejection openings 15. Accordingly, excess bubbles overflowing the buffer portions R as shown in FIG. 9A are suctioned and discharged through the ejection openings 15 as shown in FIG. 9B, so that the buffer portions R are filled with a proper amount of bubbles as shown in FIG. 9C.

Thus, excess bubbles overflowing the buffer portions R can be removed from the channels 16 of the nozzles located in the vicinity of the buffer portions R. Consequently, excess bubbles can be removed from the buffer portions R after the filling operation, thereby ensuring that the buffer portions R are filled with a proper amount of bubbles.

[Embodiment 2]

With the process of the above embodiment, an increase in the temperature of the head associated with printing may cause the bubbles accumulated in the buffer portions R to grow and overflow the buffer portions R. In this case, bubbles overflowing the buffer portions R may cause the ink to be ejected inappropriately. An embodiment will be described below which removes excess bubbles considering the growth of the bubbles associated with an increase in the temperature of the head.

For example, a head is assumed to be in the state shown in FIG. 6 at room temperature. In this state, no excess bubbles are present during printing, so that a printed image is not affected. However, as the temperature of the head increases; the head is brought into the state shown in FIG. 7 and then into the one shown in FIG. 8, where some of the nozzles are blocked with bubbles and the ink cannot be properly ejected therefrom. Thus, just before a suction operation for a recovery process, the head is heated up to a temperature that is higher than the ordinary one. Then, the bubbles in the buffer portions R are artificially thermally expanded to bring the head into the state shown in FIG. 9A before a suction operation is performed. This prevents bubbles from overflowing the buffer portions R as a result of thermal expansion and thus prevents the ink from being inappropriately ejected owing to the leaking bubbles, before the temperature of the head reaches at least the one at which the head was heated.

A head such as the one described above may be heated by any means. This heating means may comprise the heating elements 19 in the buffer chambers. That is, bubbles can be effectively expanded by causing the heating elements 19 in the buffer chambers to intensively heat bubbles in the vicinity of the buffer portions R. In this case, limiting bubbles to an appropriate size is contrary to generating bubbles. Thus, a pulse applied to the heating elements 19 in the buffering chambers in order to heat the head preferably has such a short pulse width that no bubbles are generated in the buffer chambers.

[Other Embodiments]

The print head recovery process may comprise an ejection recovery process, a suction recovery process, or a pressurization recovery process of pressurizing the ink in the common liquid chamber 17 to forcibly discharge the ink through the ejection openings 15. With the pressurization recovery process, excess bubbles overflowing the buffer portions R can be discharged and removed. Further, the buffer portions R may be filled with bubbles when the power supply for the printing apparatus is started up, each time a predetermined time elapses, when the amount of bubbles in the buffer portions R is predicted to decrease on the basis of the conditions under which the print head is driven and the environmental conditions (temperature and the like) of the printing apparatus, or at other appropriate opportunities.

Further, in a low-temperature environment or the like, the heating elements 19 in the buffer chambers may be driven just before a printing operation to allow the bubbles in the buffer portions R to grow while preventing the ink from being ejected improperly. Therefore, the capability of ink supplying to the channels 16 can be improved.

Further, in filling the buffer portions R with bubbles, while driving the heating elements 19 in the buffer portions to generate bubbles, the heating elements 19 in the nozzles that do not constitute the buffer chambers may also be driven to generate bubbles. In this case, a sufficient amount of bubbles which are to be provided to the buffer portions R can be generated. Excess bubbles may be removed by the recovery process.

Further, the ink ejecting method is not limited to the one using bubbling energy. The ejection energy generating means for ejecting ink through the ejection openings 15 may comprise the heating elements 19 or various other means such as piezoelectric elements. Furthermore, the bubble generating means for generating bubbles that are to be provided to the buffer portions R need only generate those bubbles to be provided to the buffer portion R. The configuration and disposed location of the bubble generating means are not limited to the embodiments described above.

Further, the print head 10 may be long and extend over the entire width of a printing medium. Moreover, the printing apparatus may be a full line type that effects relative movement between a print head and a printing medium in the sub-scanning direction while the print head ejects ink to print an image.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A method of filling a buffer portion in a print head with at least one bubble, using a print head comprising a plurality of ejection openings through which ink is ejected, a plurality of channels that are each in communication with a corresponding one of the plurality of ejection openings, a common liquid chamber for supplying ink to the plurality of channels, a buffer portion located at an end of an arrangement direction of said channels and adjoining, in the arrangement direction of said channels, at least one of said channels in communication with at least one corresponding ejection opening to restrain vibration of ink in said common liquid chamber which occurs as a result of ejection of the ink, and bubble generating means for filling the buffer portion with at least one bubble, comprising the steps of:

filling said buffer portion with the at least one bubble by driving said bubble generating means; and executing a recovery process of discharging the ink through said ejection openings after said bubble filling step, wherein in said recovery process step, excess of the at least one bubble filled in said buffer portion is removed;

wherein during said bubble filling step, the at least one bubble is allowed to grow up to a location immediately adjacent to said at least one channel adjoining said buffer portion by driving said bubble generating means.

2. The method according to claim 1, wherein the at least one bubble generated by driving said bubble generating means is obtained by precipitating a gas dissolved in the ink.

3. The method according to claim 1, wherein during said bubble generating step, said bubble generating means is driven to generate the at least one bubble while preventing film boiling from occurring in the ink.

4. The method according to claim 1, wherein said plurality of channels are each provided with an electrothermal converter as means for generating ejection energy that causes the ink to be ejected, and during said bubble generating step, the at least one bubble is generated using said electrothermal converters together with said bubble generating means.

5. The method according to claim 1, wherein said recovery process is a suction recovery process comprising suctioning and discharging the ink through said ejection openings.

6. The method according to claim 1, wherein the recovery process is executed before a printing operation.

7. The method according to claim 1, wherein before the recovery process, said print head is heated to a temperature used for normal printing or higher.

8. A printing apparatus able to print an image on a printing medium, using a print head comprising a plurality of ejection openings through which ink is ejected, a plurality of channels that are each in communication with a corresponding one of the plurality of ejection openings, a common liquid chamber for supplying ink to the plurality of channels, a buffer portion located at an end of an arrangement direc tion of said channels and adjoining, in the arrangement direction of said channels, at least one of said channels in communication with at least one corresponding ejection opening to restrain vibration of ink in said common liquid chamber which occurs as a result of ejection of the ink, and bubble generating means for filling the buffer chamber with at least one bubble, comprising:

recovery process means for causing the ink to be discharged through said ejection openings, wherein said recovery process means causes the ink to be discharged through said ejection openings after said bubble generating means has filled said buffer portion with at least one bubble, and said recovery process means discharges the ink through said ejection openings to remove excess of the at least one bubble, wherein said bubble generating means allows the at least one bubble to grow up to a location immediately adjacent to said at least one channel adjoining said buffer portion.

9. The printing apparatus according to claim 8, wherein said bubble generating means generates the at least one bubble by precipitating a gas dissolved in the ink.

10. The printing apparatus according to claim 8, wherein said bubble generating means generates the at least one bubble while preventing film boiling from occurring in the ink.

11. The printing apparatus according to claim 8, wherein said plurality of channels are each provided with an electrothermal converter as means for generating ejection energy that causes the ink to be ejected, and said bubble generating means generates the at least one bubble together with said electrothermal converter.

12. The printing apparatus according to claim 8, wherein said recovery process means suctions and discharges the ink through said ejection openings.

13. The printing apparatus according to claim 8, wherein said recovery process means discharges the ink through said ejection openings before a printing operation.

14. The printing apparatus according to claim 8, further comprising means for heating said print head to a temperature used for normal printing or higher before said recovery process means discharges the ink through said ejection openings.

* * * * *

UNITED STATES PATENT AND TRADEMARK OFFICE

CERTIFICATE OF CORRECTION

PATENT NO. : 6,877,835 B2
DATED : April 12, 2005
INVENTOR(S) : Kato et al.

It is certified that error appears in the above-identified patent and that said Letters Patent is hereby corrected as shown below:

Column 3,
Line 55, “element” should read -- elements --.

Column 5,
Line 51, “the,” should read -- the --.

Column 6,
Line 7, “portions R” should read -- portions R. --.
Line 62, “increases;” should read -- increases, --.

Column 8,
Line 29, “removed;” should read -- removed, --.
Line 67, “direc” should read -- direc- --.

Signed and Sealed this

Twenty-fourth Day of January, 2006

JON W. DUDAS
*Director of the United States Patent and Trademark Office*